United States Patent [19]

Shibuya et al.

[11] Patent Number: 4,742,277

[45] Date of Patent: May 3, 1988

[54] PULSE GENERATING APPARATUS FOR XENON LAMP AND LIGHTING METHOD THEREOF

[75] Inventors: Masakazu Shibuya, Yokosuka; Yasuki Mori, Yokohama; Yoshiyuki Tokuda, Yokosuka; Yoichiro Mitsuyuki, Tokyo; Akihiro Kamiya, Yokohama, all of Japan

[73] Assignee: Kabushiki Kaisha Toshiba, Kawasaki, Japan

[21] Appl. No.: 79,049

[22] Filed: Jul. 29, 1987

[30] Foreign Application Priority Data

Jul. 29, 1986 [JP] Japan ..... 61-178307

[51] Int. Cl.[4] ..... H05B 37/00

[52] U.S. Cl. ..... 315/176; 315/241 P; 315/241 S; 315/290

[58] Field of Search ..... 315/241 S, 176, 175, 315/290

[56] References Cited

U.S. PATENT DOCUMENTS

| | | | |
|---|---|---|---|
| 3,444,430 | 5/1969 | Needham | 315/176 |
| 3,551,738 | 12/1970 | Young | 315/176 |
| 4,128,788 | 12/1978 | Lawther | 315/176 |

OTHER PUBLICATIONS

"Simple Pulse Generator for Pulsing Xenon Arcs with High Repetition Rate", Rev. Sci. Instrum., vol. 45, No. 2, Feb. 1974, p. 318, G. Beck.

*Primary Examiner*—Harold Dixon
*Attorney, Agent, or Firm*—Oblon, Fisher, Spivak, McClelland & Maier

[57] ABSTRACT

A pulse generating apparatus includes a base current supply section for generating a constant DC current having a first prescribed current level for turning on a xenon lamp, and a pulse current section for adding a pulse current having a second current level greater than the first current level and a prescribed pulse duration within a prescribed repetition period to the constant DC current. The base current supply section and pulse current section should satisfy the following equations:

$$1.4 \leqq I_{max}/I_{mini} \leqq 6$$

$$0.2 \leqq t/T \leqq 0.7$$

$$T \leqq 1/40$$

Where Imax is the sum of the first and the second prescribed current levels, Imini is the first prescribed current level, T is the prescribed repetition period, and t is the prescribed pulse duration.

When the pulse current added to the DC current is supplied to a xenon lamp, the xenon lamp outputs a strong light during the pulse duration of the pulse current, and a feeble light during the absence of the pulse current.

6 Claims, 3 Drawing Sheets

PULSE GENERATING APPARATUS FOR XENON LAMP AND LIGHTING METHOD THEREOF

BACKGROUND OF THE INVENTION

1. Field of the Invention

The present invention relates, in general, to a pulse generating apparatus for a xenon lamp. In particular, the invention relates to a pulse generating apparatus for a xenon lamp which is used in a motion picture projector. The invention also relates to a method for lighting a xenon lamp.

2. Description of the Prior Art

A xenon lamp is a kind of arc lamp. The luminous flux of the xenon lamp reaches a stable level immediately after lighting, and the luminance thereof is extremely high. Furthermore, the xenon lamp has good rendering properties, and the color temperature and the molecular spectral distribution thereof are similar to that of sunlight. A xenon lamp may be a short arc lamp or a long arc lamp. In general, since the long arc lamp has a large luminous energy, it is used for lighting a wide space. On the other hand, the short arc lamp is similar to a point light source. Such a short arc lamp often is used as a light source for a motion picture projector.

In conventional motion picture projectors using a xenon short art lamp as a light source, the xenon lamp remains on continuously, and the light therefrom is regularly interrupted by a shutter in synchronism with the frame feeding of a moviefilm. In this type of projector, however, a luminance change of the light is caused when the light from the lamp is interrupted. As a result, flickers occur on the moviescreen.

To reduce the flicker described above, a shutter device including two blades disposed opposite to one the other may be used for interrupting the light from the xenon lamp. If the frame feeding speed of the moviefilm is 24 frames/second, the shutter device is rotated at 24 times/second. Therefore, the light from the lamp is interrupted 48 times/second. This type of shutter device may reduce or eliminate the flicker on the screen. However, in this system wherein the light from the lamp is interrupted by the shutter, the xenon lamp remains lighted at a prescribed current value even when the shutter is closed. Therefore, the luminous efficiency of the lamp is adversely affected.

To solve the above problem, a shutterless system has been developed. One such shutterless system is disclosed in Japanese Utility Model publication No. 30134/1981 laid open on Sept. 22, 1977, and entitled ARC LAMP.

In this system, a prescribed minimum current, e.g., 1 A, is supplied to a xenon lamp for maintaining the arc of the lamp. Under this minimum current, no perceived illumination of the xenon lamp occurs. A large pulse current, e.g., 38 A, is overlaid on the minimum current to illuminate the xenon lamp at a prescribed interval. Therefore, the xenon lamp is frequently turned on and off in synchronism with the application of the pulse current. According to this system, effects similar to those of the above-described shutter system also may be achieved in this system. Furthermore a higher luminous efficiency is achieved in comparison with the shutter system. This is because a large pulse current is supplied only when the xenon lamp is turned on. However, in this shutterless system, since the current change between the minimum current and the pulse current overlaid on the minimum current is large, the temperature change of the electrodes of the xenon lamp also is large. As a consequence, deterioration of the electrodes of the lamp is caused, and the life of the lamp is adversely affected.

SUMMARY OF THE INVENTION

It is an object of the present invention to improve the luminous efficiency of a xenon lamp energized by a pulse generating apparatus.

It is another object of the present invention to avoid a large temperature change of the electrodes of a xenon lamp when the lamp is turned on and off.

To accomplish the above-described objects, the pulse generating apparatus includes a base current supply section for generating a consstant DC current having a first prescribed current level for turning on a xenon lamp, and a pulse current section for adding a pulse current having a second current level greater than the first current level and a prescribed pulse duration within a prescribed repetition period to the constant DC current. The base current supply section and pulse current section should satisfy the following equations:

$$1.4 \leqq Imax/Imini \leqq 6$$

$$0.2 \leqq t/T \leqq 0.7$$

$$T \leqq 1/40$$

where Imax is the sum of the first and the second prescribed current levels, Imini is the first prescribed current level, T is the prescribed repetition period, and t is the prescribed pulse duration.

When the pulse current added to the DC current is supplied to a xenon lamp, the xenon lamp outputs a strong light during the pulse duration of the pulse current, and a feeble light during the absence of the pulse current. The apparatus may include a shutter for interrupting the path of light from the xenon lamp only during the portion of the repetition period other than the prescribed pulse duration. The pulse current section may includes a generating section for generating a plurality of pulse current elements during one interrupting period of the shutter. Each pulse current element has the second prescribed current level and a prescribed pulse duration. The prescribed pulse duration t is the sum of the pulse duration of each pulse current element.

BRIEF DESCRIPTION OF THE DRAWINGS

The present invention is best undertsood with reference to accompanying drawings in which:

FIG. 4(*b*) is a waveform diagram of the pulse current shown in FIG. 2;

FIG. 5(*b*) is a waveform diagram illustrating another example of a pulse current wave of the invention applied to a xenon lamp.

DETAILED DESCRIPTION OF THE PREFERRED EMBODIMENTS

Referring to the accompanying drawings, an embodiment of the present invention will be described.

Figure 1:
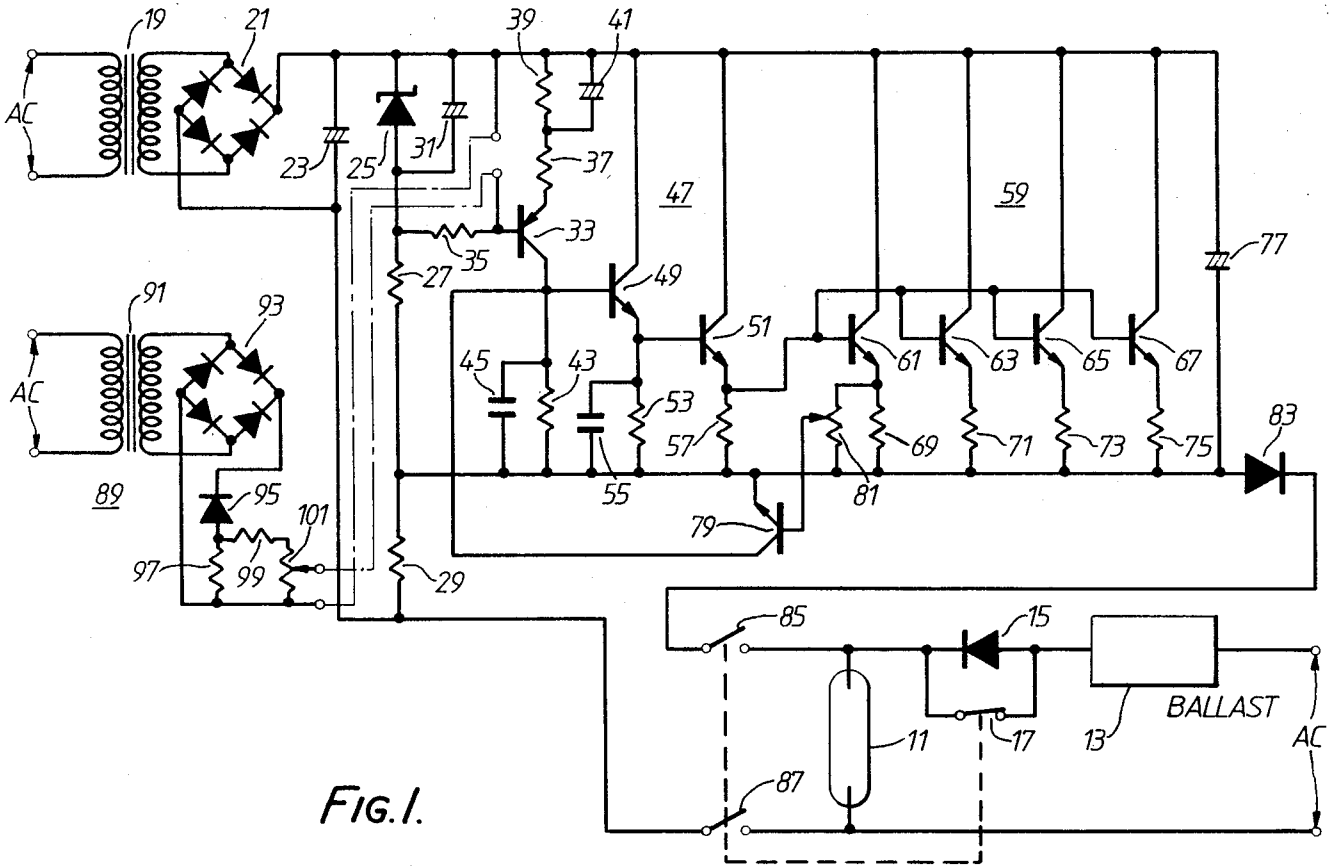
FIG. 1 is a circuitry diagram of one embodiment of the present invention.

FIG. 1 is a circuit diagram of a pulse generating circuit of one embodiment.

A voltage of an AC power source is applied to a pair of electrodes of a xenon lamp 11 through a ballast 13 and a rectifying diode 15. A first switch 17 is connected in parallel with diode 15. The primary winding of a power transformer 19 is connected to a 50 Hz AC power source. The secondary winding of power transformer 19 is connected to the input side of a full wave rectifying diode bridge circuit 21. A smoothing capacitor 23 is connected to the output side of bridge circuit 21. Smoothing capacitor 23 also is connected in parallel with a serial circuit including a zener diode 25 and resistors 27 and 29. A capacitor 31 is connected in parallel with diode 25. The connecting point between diode 25 and resistor 27 is connected to the base of a first PNP transistor 33 through a resistor 35. The emitter of first transistor 33 is connected to smoothing capacitor 23 through resistors 37 and 39. A capacitor 41 is connected in parallel with resistor 39. The collector of first transistor 33 is connected to the connecting point between resistors 27 and 29 through a resistor 43. A capacitor 45 is connected in parallel with resistor 43.

A first amplifying circuit 47 includes a second NPN transistor 49 and a third NPN transistor 51. The base of second transistor 49 is connected to the connecting point between the collector of first transistor 33 and resistor 43. The collector of second transistor 49 is connected to smoothing capacitor 23, and the emitter thereof is connected to the connecting point between resistors 27 and 29 through a resistor 53. A capacitor 55 is connected in parallel with resistor 53. The collector of third transistor 51 is connected to smoothing capacitor 23. The base of third transistor 51 is connected to the emitter of second transistor 49, and the emitter thereof is connected to the connecting point between resistors 27 and 29 through a resistor 57.

A second amplifying circuit 59 includes a fourth NPN transistor 61, a fifth NPN transistor 63, a sixth PNP transistor 65 and a seventh PNP transistor 67. The base of fourth transistor 61 is connected to the connecting point between the emitter of third transistor 51 and resistor 57, and to each base of transistors 63, 65 and 67. The collector of fourth transistor 61 is connected to smoothing capacitor 23, and the emitter thereof is connected to the connecting point between resistors 27 and 29 through a resistor 69. Similarly, each collector of transistors 63, 65 and 67 is connected to a smoothing capacitor 23. The emitter of transistor 63 is connected to the connecting point between resistors 27 and 29 through a resistor 71. The emitter of transistor 65 is connected to the connecting point between resistors 27 and 29 through a resistor 73. The emitter of transistor 67 also is connected to the connecting point between resistors 27 and 29 through a resistor 75. A capacitor 77 is connected between the collector of transistor 67 and the connecting point between resistors 27 and 29.

The emitter of a eighth NPN transistor 79 is connected to the connecting point between resistors 27 and 29, and the collector thereof is connected to the connecting point between the collector of transistor 33 and the base of transistor 49. The base of transistor 79 is connected to the slide terminal of a variable resistor 81. Variable resistor 81 is connected in parallel with resistor 69. The cathode of a diode 83 is connected to the connecting point between resistors 27 and 29, and the anode thereof is connected to one electrode of xenon lamp 11 through a second switch 85. The other electrode of xenon lamp 11 is connected to the connecting point between smoothing capacitor 23 and resistor 29 through a third switch 87. First, second and third switches 17, 85 and 87 respond to the operation of xenon lamp 11. First switch 17 is closed, and second and third switches 85 and 87 are opened before lamp 11 is turned on. On the other hand, first switch 17 is opened, and second and third switches 85 and 87 are closed after lamp 11 is turned on.

A pulse generating circuit 89 will be described below.

The primary winding of a power transformer 91 is connected to an AC power source, and the secondary winding thereof is connected to the input side of a full-wave rectifying diode bridge circuit 93. A zenor diode 95 is connected between the output side of diode bridge circuit 93 through a resistor 97. Resistor 97 is connected in parallel with a serial circuit including a resistor 99 and a variable resistor 101. The slide terminal of variable resistor 101 is connected to the base of transistor 33. The connecting point between resistor 97 and variable resistor 101 is connected to smoothing capacitor 23. Pulses generated by pulse generating circuit 89 are amplified by first amplifying circuit 47, and amplified pulses are fed to second amplifying circuit 59. The DC voltage fed from bridge circuit 21 through smoothing capacitor 23 is pulse-amplified by second amplifying circuit 59 on the basis of the amplified pulses fed from first amplifying circuit 47. The pulse current is fed from second amplifying circuit 59 to xenon lamp 11 through second and third switches 85 and 87. The repetition period of the pulse current is the same as that of the AC voltage source, i.e., 1/50 sec.

Figure 2:
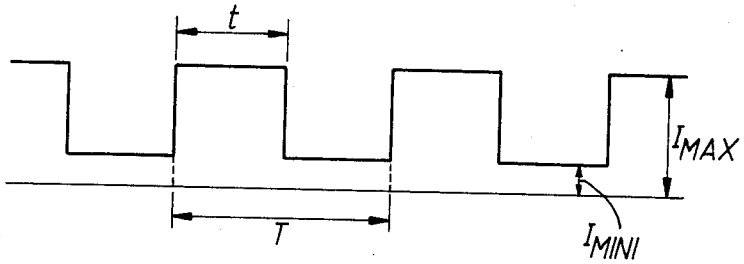
FIG. 2 is a waveform diagram illustrating a pulse current applied to a xenon lamp from a pulse generating circuit shown in FIG. 1.

The operation of the above-described circuit will be described. As described above, first switch 17 is closed, and second and third switches 85 and 87 are opened when xenon lamp 11 is turned on. A prescribed starting current is supplied to xenon lamp 11 through ballast 13 and first switch 17 to operate xenon lamp 11. After lighting of xenon lamp 11, first switch 17 is opened, and second and third switches 85 and 87 are closed. A prescribed minimum current Imin is supplied to xenon lamp 11 through ballast 13 and diode 15. Under this condition, a prescribed feeble illumination occurs in xenon lamp 11. The minimum current Imin is continuously supplied to xenon lamp 11. The pulse current also is supplied from second amplifying circuit 59 to xenon lamp 11 at a predetermined period T sec. The pulse current from second amplifying circuit 59 is overlaid on the minimum current Imin. Therefore, the maximum current Imax is periodically supplied to xenon lamp 11 for a predetermined time t sec, as shown in FIG. 2.

In this pulse generating circuit shown in FIG. 1, the preferred relationship between Imini and Imax generally should satisfy the following expression:

$$1.4 \leqq Imas/Imini \leqq 6 \quad (1)$$

The preferred relationship between the period T and the pulse duration t for which the pulse current is supplied to the xenon lamp generally satisfy the following expression:

$$0.2 \leqq t/T \leqq 0.7 \quad (2)$$

In order to visually reduce or eliminate flicker to a typical observer, the period T should satisfy the following expression:

$$T \leqq 1/40 \quad (3)$$

In general, human eyes perceive flickers when lamp periodically on by a pulse current. When the lamp is turned on and off at a first rate, the human eyes perceive the light from the lamp as a continuous light. As a result of the experiment, flickers were percieved when T is greater than 1/40 sec..

In this embodiment, Imax is 22A, and Imini is 7.5A. The ratio of t to T is 0.5, and T is 1/50 sec.

As shown in FIG. 2, the minimum current Imini is continuously supplied to xenon lamp 11, and the prescribed feeble light based on the minimum current Imini is maintained, as stated above. The pulse current from second amplifying circuit 59 is periodically overlaid on the minimum current Imini. Therefore, the maximum current Imax is supplied to the xenon lamp for t seconds, i.e., 1/59 sec. The strong light of xenon lamp 11 occurs for t seconds. Since period T is set to 1/50 sec., the strong light occurs fifty times per second. A comparison was carried out between the embodiment described above and the prior art wherein the xenon lamp was continuously on, and the light therefrom is interrupted by a shutter. The results are shown in Table I, below.

Imini and Imax are repeatedly supplied to a xenon lamp at a predetermined fast pulse rate.

According to this experiment, when the ratio of the maximum current Imax to the minimum current Imini is greater than 6, a heat-stable state and a heat-unstable state repeatedly occur on the pair of electrodes at a fast pulse rate, since the change of the lamp current fed to the pair of electrodes of the xenon lamp is large. The pair of electrodes of the xenon lamp is easily damaged and therefore the lamp life is extremely short. If the ratio of the maximum current Imax to the minimum current Imini is less than 1.4, the change of the lamp current is extremely small. As a consequence, an increase of the average power consumption is required to achieve a desired maximum light quantity of the xenon lamp. This causes a decrease of the luminous efficiency of the lamp.

According to the above-described embodiment, the luminous efficiency of the xenon lamp may be improved, as compared with the prior art. A large temperature change of the electrodes of the xenon lamp may be avoided, and an extended life of the xenon lamp may be achieved. Furthermore, the required power consumption in this embodiment may be reduced to obtain the same luminous flux as that of the prior art.

In this embodiment, the period T of the pulse current typically is set to 1/50 sec. However, it may be changed when the variable output of an invertor is input to the primary winding of power transistor 91 shown in FIG. 1.

TABLE I

| | | Lamp Current (A) | Lamp Voltage (V) | Lamp Power Consumption (W) | (average) | Luminous Flux (%) | (average) |
|---|---|---|---|---|---|---|---|
| First | Imini | 7.5 | 16.0 | 120 | (330) | 27 | (106.5) |
| Embodiment | Imax | 22.0 | 24.5 | 539 | | 186 | |
| Prior Art | I | 17.5 | 20 | 350 | | 100 | |

In TABLE I, the relative luminous flux of this embodiment was calculated on the assumption that the luminous flux of the prior art was one hundred percent. In this case, the average power consumption of the lamp is different between this embodiment, i.e., 330 W, and the prior art, i.e., 350 W. If a comparison was made between this embodiment and the prior art at the same power consumption, the converted luminous flux of this embodiment can be obtained by multiplying the luminous flux of this embodiment shown in TABLE I by the ratio of 350 to 330. In this case, the converted luminous flux of this embodiment for 350 W lamp power consumption is 113. Thus, the luminous efficiency of this embodiment may be improved about 13%, as compared with the prior art.

In the visual observation of this embodiment, the quantity of the light from the xenon lamp was observed as substantially a constant value in spite of the frequent changes from the strong light to the feeble light. Furthermore, since the strong light has a great influence upon the luminosity, the luminosity of the light from the xenon lamp was felt by visual observers more than an average of the luminous flux of Imini and Imax. The result of this observation suggests Imax (strong light) may give a strong impression to visual observers when A second embodiment of the present invention now will be described.

Figure 3:
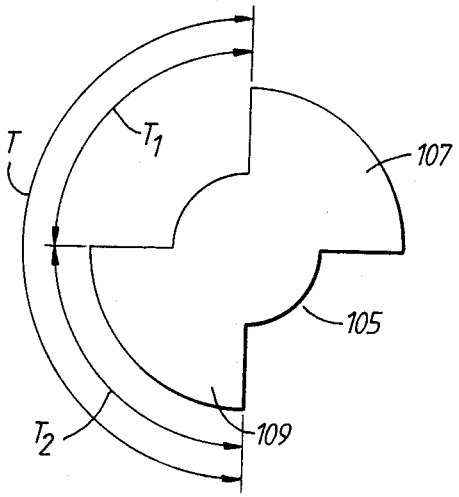
FIG. 3 is a schematic plan view illustrating a shutter device of a second embodiment of the invention.

In this embodiment, a shutter element shown in FIG. 3 is added to the embodiment described above. Shutter element 105 includes a pair of vanes 107 and 109 integrally formed opposite to one the other, as shown in FIG. 3.

Figure 4A:
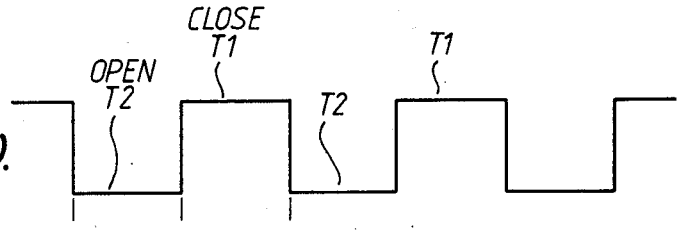
FIG. 4(*a*) is a timing chart of the shutter device shown in FIG. 3.
Figure 4B:
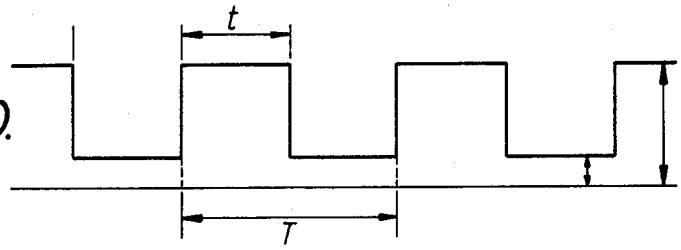

When the rotation period of shutter element 105 is 2T, the shutter action of each vane is performed during the absence of the pulse current, as shown in FIGS. 4*a* and 4*b*.

With the second embodiment, the feeble light from the xenon lamp is interrupted by each vane of shutter element 105. When the second embodiment is applied to a motion picture projector, each frame of a film may be moved during the interrupting period. The movement of the frame of the film is not seen by viewers. A high quality motion picture may be provided.

The following TABLE II shows a comparison between the second embodiment and the prior art wherein the xenon lamp is continuously on, and the light therefrom is periodically interrupted by the shutter. The rated power of the xenon lamp used in this comparison was 350 W.

TABLE II

| | | Lamp Current (A) | Lamp Voltage (V) | Lamp Power Consumption (W) | (average) | Luminous Flux (%) | Effective Luminous Flux (%) |
|---|---|---|---|---|---|---|---|
| Second Embodiment | Shutter Close | 7.5 | 16.0 | 120 | (330) | 27 | 186 |

TABLE II-continued

| | | Lamp Current (A) | Lamp Voltage (V) | Lamp Power Consumption (W) | (average) | Luminous Flux (%) | Effective Luminous Flux (%) |
|---|---|---|---|---|---|---|---|
| | Shutter Open | 22.0 | 24.5 | 539 | | 186 | |
| Prior Art | Shutter Close | 17.5 | 20 | 350 | (350) | 100 | 100 |
| | Shutter Open | 17.5 | 20 | 350 | | 100 | |

As can be understood from TABLE II, the total effective luminous flux of the second embodiment may be increased 86% in spite of the low power consumption, as compared with the prior art.

In the above described embodiment, one pulse current is overlaid on the minimum current during each open period of each vane of the shutter element. However, a plurality of pulse currents may be overlaid on the minimum current during each open period of each vane, as shown in FIG. 5.

Figure 5A:
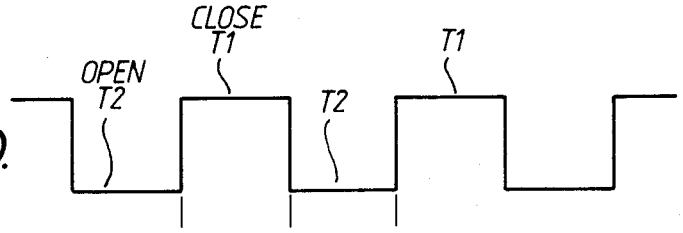
FIG. 5(*a*) is another timing chart of the shutter device shown in FIG. 3.
Figure 5B:
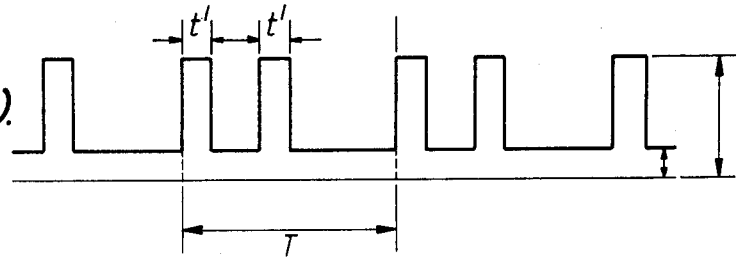

In FIG. 5, two pulse currents are overlaid on the minimum current Imini during the open period of each vane of the shutter element. Each pulse current has a t' pulse duration. The total pulse duration t is 2t' in this case. If the total pulse duration t satisfies the expression (2), the sufficient effective luminous flux may be obtained. For example, the sufficient luminous flux from the xenon lamp may be provided on the motion picture screen. Furthermore, since the maximum pulse current is supplied repeatedly to the xenon lamp at a great rate, the flicker on the screen may be reduced greatly.

To avoid the flicker on the motion picture screen, it is desirable that the total pulse duration t of the pulse current and the duration of the minimum current at which the feeble light is generated by the xenon lamp be close to one another during the open period of the shutter element. This was confirmed through various experiments by inventors.

In the above-described embodiment, the pulse current is overlaid on the minimum current in synchronism with the operation of the shutter element. However, the pulse current may be applied to the xenon lamp before the shutter is opened, and may be stopped after the shutter is closed for only supplying a maximum luminous flux to the moviescreen.

In the embodiments described above, the present invention is applied to a motion picture projector. However, the invention may be applied to other apparatus wherein a light source is interrupted at a prescribed interval, such as an original plate making apparatus.

The present invention has been described with respect to specific embodiments. However, other embodiments based on the principles of the present invention will be obvious to those of ordinary skill in the art. Such embodiments are intended to be covered by the claims.

What is claimed is:

1. A pulse generating apparatus for a xenon lamp, comprising:

base current means for generating a constant DC current having a first prescribed current level for turning on the xenon lamp; and pulse current means for adding a pulse current having a second prescribed current level greater than the first current level and a prescribed pulse duration within a prescribed repetition period to the constant DC current, the base current means and pulse current means satisfying the following equations:

$$1.4 \leqq Imax/Imini \leqq 6$$

$$0.2 \leqq t/T \leqq 0.7$$

$$T \leqq 1/40$$

where Imax is the sum of the first prescribed current level and the second prescribed current level, Imini is the first prescribed current level, T is the prescribed repetition period, and t is the prescribed pulse duration.

2. An apparatus according to claim 1, wherein the base current means includes a ballast.

3. An apparatus according to claim 1 further including a shutter for interrupting the path of light from the xenon lamp only during the portion of the repetition period other than the prescribed pulse duration.

4. An apparatus according to claim 3, wherein the pulse current means includes means for generating a plurality of pulse current elements having the second prescribed current level and a prescribed pulse duration during one interrupting period of the shutter, the prescribed pulse duration t being the sum of the pulse duration of each pulse current element.

5. A method for lighting a xenon lamp, including the steps of:

generating an operating pulse current, which has a periodic pulse current element and a constant base current element, and which satisfies the equations:

$$1.4 \leqq Imax/Imini \leqq 6$$

$$0.2 \leqq t/T \leqq 0.7$$

$$T \leqq 1/40$$

where Imax is the sum of the current levels of the pulse current element and the base current element, Imini is the current level of the base current element, t is the pulse duration of the pulse current element, and T is the repetition period of the pulse current element; and applying the operating pulse current to the xenon lamp.

6. A method according to claim 5 further including step of intermittently interrupting the path of light from the xenon lamp during the period when the pulse current element is absent.

* * * * *